US011549767B2

(12) United States Patent
Curry

(10) Patent No.: US 11,549,767 B2
(45) Date of Patent: Jan. 10, 2023

(54) GAS OPERATED ROTARY BARREL ACTION AND PISTOL

(71) Applicant: Smith & Wesson Inc., Springfield, MA (US)

(72) Inventor: Brett Curry, Monson, MA (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 17/408,870

(22) Filed: Aug. 23, 2021

(65) Prior Publication Data

US 2022/0120524 A1 Apr. 21, 2022

Related U.S. Application Data

(60) Provisional application No. 63/093,548, filed on Oct. 19, 2020.

(51) Int. Cl.

| | |
|---|---|
| ***F41A 3/28*** | (2006.01) |
| ***F41C 3/00*** | (2006.01) |
| ***F41A 5/20*** | (2006.01) |
| ***F41A 5/24*** | (2006.01) |

(52) U.S. Cl.

CPC ..... *F41A 3/28* (2013.01); *F41A 5/20* (2013.01); *F41A 5/24* (2013.01); *F41C 3/00* (2013.01)

(58) Field of Classification Search

CPC ..... F41A 3/28; F41A 5/18; F41A 5/20; F41A 5/24; F41A 5/26; F41C 3/00

See application file for complete search history.

(56) References Cited

U.S. PATENT DOCUMENTS

| | | | | | |
|---|---|---|---|---|---|
| 663,955 | A * | 12/1900 | Burgess | F41A 3/16 | 42/11 |
| 834,753 | A * | 10/1906 | Reifgraber | F41A 3/38 | 89/159 |
| 929,491 | A * | 7/1909 | Reifgraber | F41A 3/38 | 89/148 |
| 1,427,966 | A * | 9/1922 | Nickl | F41A 3/16 | 89/196 |
| 2,468,784 | A * | 5/1949 | Seagraves | F41A 3/26 | 89/185 |

(Continued)

FOREIGN PATENT DOCUMENTS

| | | | |
|---|---|---|---|
| CN | 105953641 | A * | 9/2016 |
| CN | 105571388 | | 11/2016 |

(Continued)

*Primary Examiner* — Gabriel J. Klein
(74) *Attorney, Agent, or Firm* — Ballard Spahr LLP

(57) ABSTRACT

An action for a firearm uses a rotating barrel on which are mounted lugs and a cam follower. The barrel is positioned coaxially within a tube fixed to the frame of the firearm. A cam, engaged by the cam follower, is also fixed to the frame. A gas space is defined between the tube and the barrel by a thrust surface on the barrel and a reaction surface on the tube. A gas port connects the gas space with the barrel's bore. A slide overlies the tube and defines longitudinally oriented grooves which receive the lugs when the barrel is rotated by interaction between the cam and the cam follower to align the lugs and the grooves. Motion of the barrel is arrested by interaction between the cam and cam follower, and motion of the slide relative to the barrel is permitted when the lugs align and engage the grooves.

17 Claims, 5 Drawing Sheets

(56) References Cited

U.S. PATENT DOCUMENTS

| | | | | | |
|---|---|---|---|---|---|
| 2,581,395 | A * | 1/1952 | Elfstrom | F41A 3/86 | 89/14.3 |
| 3,273,460 | A * | 9/1966 | Mason | F41A 5/24 | 89/185 |
| 3,306,168 | A | 2/1967 | Blumrick | | |
| 3,848,511 | A * | 11/1974 | Zanoni | F41A 5/26 | 89/191.02 |
| 4,373,423 | A * | 2/1983 | Moore | F41A 5/26 | 89/193 |
| 4,563,937 | A * | 1/1986 | White | F41A 21/484 | 89/185 |
| 4,580,484 | A * | 4/1986 | Moore | F41A 5/18 | 89/187.02 |
| 4,619,184 | A | 10/1986 | Shalev | | |
| 4,909,129 | A * | 3/1990 | Reynolds | F41A 5/18 | 89/193 |
| 5,050,480 | A | 9/1991 | Knight, Jr. et al. | | |
| 5,138,931 | A * | 8/1992 | Brookshire | F41A 9/47 | 89/191.01 |
| 6,112,636 | A | 9/2000 | Besselink | | |
| 8,065,950 | B2 | 11/2011 | Kaminsky | | |
| 8,752,474 | B2 | 6/2014 | Vanek | | |
| 9,766,026 | B2 | 9/2017 | Hirt et al. | | |
| 10,018,433 | B2 * | 7/2018 | Tuason | F41A 3/46 | |
| 10,203,172 | B2 | 2/2019 | Dechant | | |
| 2011/0017058 | A1 * | 1/2011 | Kaminsky | F41A 5/26 | 89/191.01 |
| 2012/0085225 | A1 * | 4/2012 | Vanek | F41A 5/06 | 89/163 |
| 2014/0196337 | A1 * | 7/2014 | Bandini | F41A 3/44 | 42/16 |
| 2015/0316336 | A1 * | 11/2015 | Lee | F41A 3/38 | 42/16 |
| 2017/0198993 | A1 * | 7/2017 | Dechant | F41A 5/06 | |
| 2018/0347926 | A1 * | 12/2018 | Lopatin | F41A 3/26 | |
| 2021/0372721 | A1 * | 12/2021 | Zukowski | F41A 5/24 | |

FOREIGN PATENT DOCUMENTS

| | | |
|---|---|---|
| FR | 2310544 | 12/1976 |
| GB | 276894 | 9/1927 |
| GB | 465041 A * | 4/1937 |
| GB | 1567317 | 5/1980 |
| RU | 2616454 | 11/2015 |

* cited by examiner

GAS OPERATED ROTARY BARREL ACTION AND PISTOL

CROSS REFERENCE TO RELATED APPLICATIONS

This application is based upon and claims benefit of priority to U.S. Provisional Application No. 63/093,548, filed Oct. 19, 2020, which application is hereby incorporated by reference herein.

FIELD OF THE INVENTION

This invention concerns actions for firearms.

BACKGROUND

Low recoil impulse cartridges such as the FN 5.7×28 mm, .22 Winchester Magnum Rimfire and .17 Hornady Magnum Rimfire generally do not work well in pistols using the Browning short recoil locked breech actions and require use of blowback, delayed blowback or locked breech gas operated systems for reliable operation. There is clearly an opportunity to improve on the reliability of such actions.

SUMMARY

The invention concerns an action, and a pistol incorporating the action. In an example embodiment the pistol comprises a frame and the action comprises a cam fixedly mounted on the frame. A slide is movably mounted on the frame. The slide defines a first groove extending lengthwise therealong. A tube is fixedly mounted on the frame between the slide and the frame. The cam may be integrally formed with the tube. A barrel is positioned within the tube. The barrel has a longitudinal axis and defines a bore coaxial therewith. A cam follower is mounted on the barrel. The cam follower is engageable with the cam for rotating the barrel about the longitudinal axis. A first lug is mounted on the barrel and projects outwardly therefrom. The first lug is engageable with the first groove upon rotation of the barrel about the longitudinal axis. A thrust surface projects outwardly from the barrel toward the tube. The thrust surface faces a reaction surface projecting from the tube toward the barrel. A gas space is defined between the thrust surface and the reaction surface. A port in the barrel extends between the bore and the gas space.

In an example embodiment the cam follower is mounted on the barrel proximate to a breech end thereof. Further by way of example the first lug is mounted on the barrel proximate to a breech end thereof. A second lug may be mounted on the barrel to project outwardly therefrom. The slide may define a second groove extending lengthwise therealong. The second lug is engageable with the second groove upon rotation of the barrel about the longitudinal axis. In an example embodiment the first and second lugs are mounted proximate to a breech end of the barrel.

By way of example the port is positioned proximate to a muzzle end of the barrel. An example embodiment may further comprise a plurality of supplemental thrust surfaces projecting from the barrel toward the tube. The supplementary thrust surfaces are in spaced relation to one another lengthwise along the barrel.

DETAILED DESCRIPTION

Figure 1:
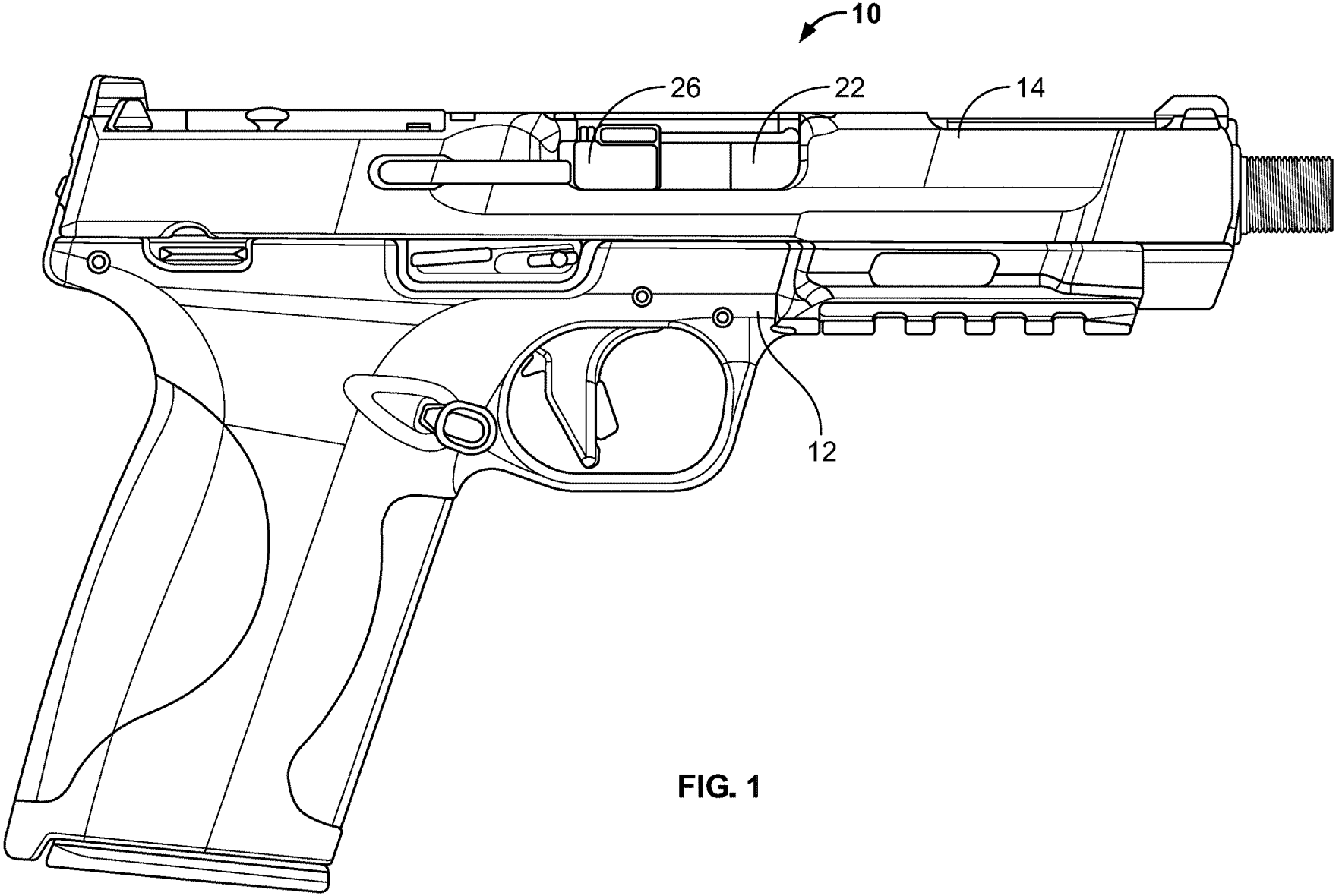
FIG. 1 is a right side view of an example firearm according to the invention.
Figure 2:
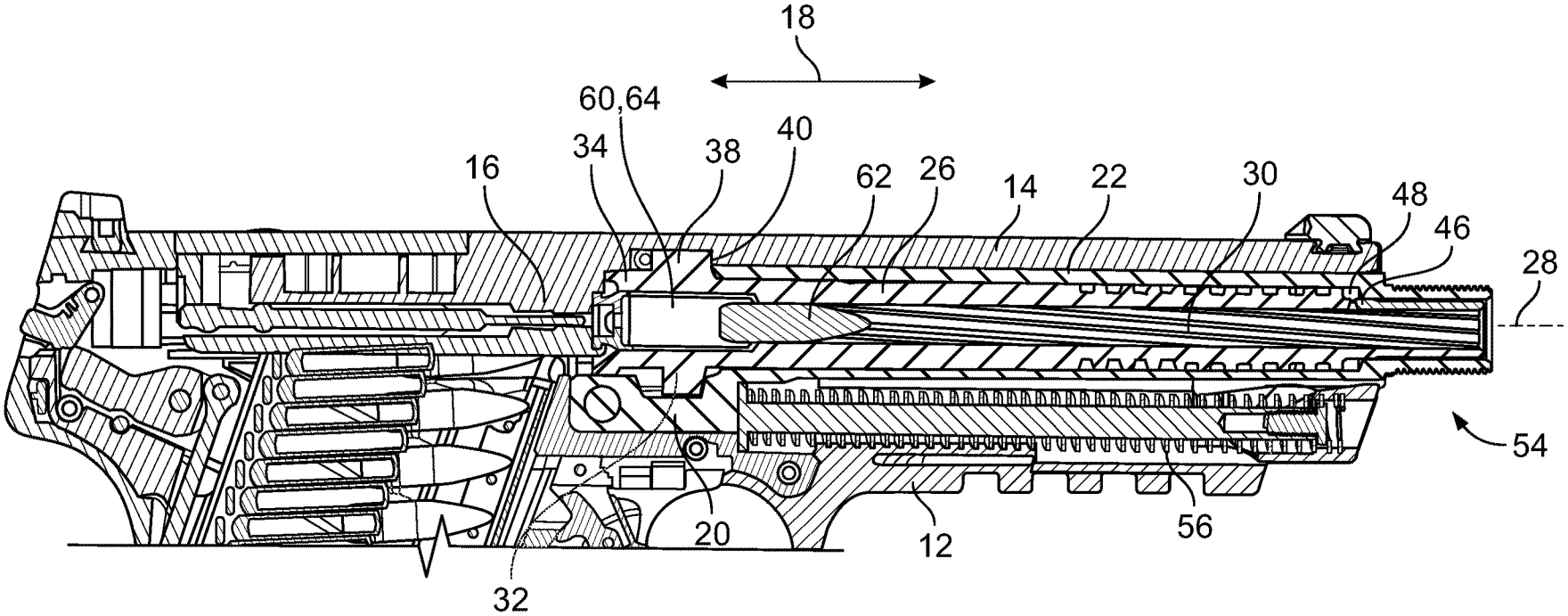
FIG. 2 is a partial sectional view of the firearm shown in FIG. 1 illustrating an example action according to the invention.

The invention concerns a gas operated action for a firearm, and a pistol using such an action. FIG. 1 shows an example pistol 10 according to the invention. Pistol 10 comprises a frame 12 on which a slide 14 is mounted. As shown in FIG. 2, slide 14 comprises a bolt 16 and, as is well understood, the slide is reciprocably movable on frame 12 along a line of action 18 between a battery position (shown) and an open position (out of battery) when the pistol executes its firing cycle.

Figure 3:
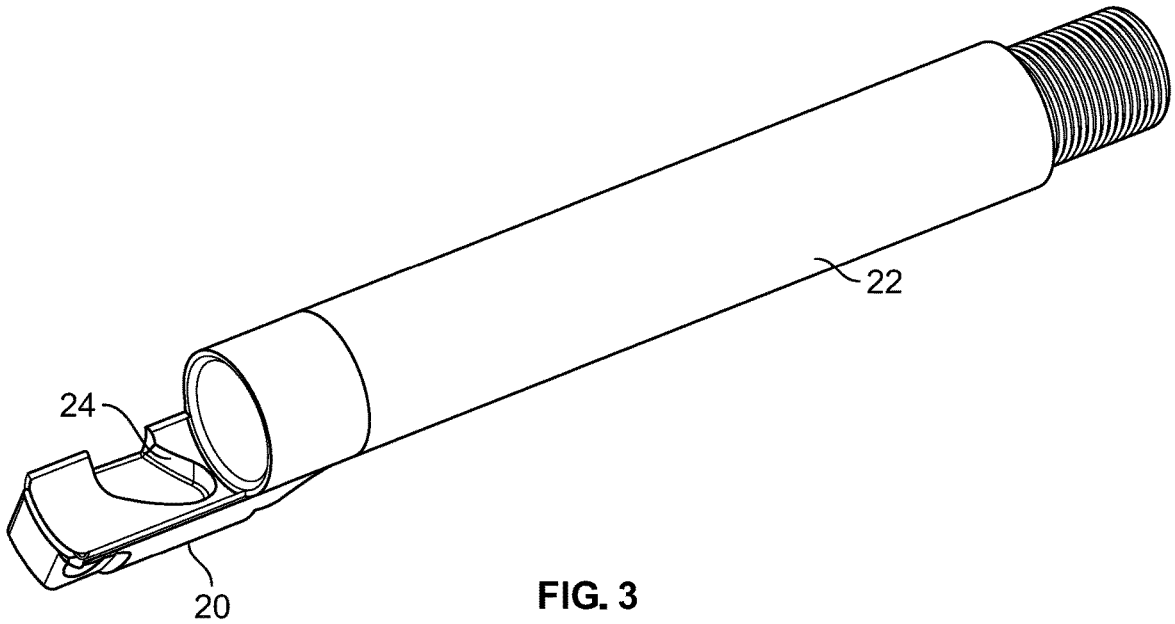
FIG. 3 is an isometric view of a component of the firearm shown in FIG. 1.

As further shown in FIG. 2, a cam 20 and a tube 22 are fixedly mounted on frame 12 between the frame and the slide 14. FIG. 3 shows an example embodiment wherein the cam 20 is integrally formed with the tube 22. Cam 20 defines cam surfaces 24 which control the linear and rotary motion of a barrel 26, shown in FIGS. 2 and 4. As shown in FIG. 2, the barrel 26 is positioned within the tube 22, has a longitudinal axis 28, and defines a coaxial bore 30. A cam follower 32 (see also FIG. 4) is mounted on the barrel 26. In this example embodiment, the cam follower 32 is mounted proximate to the breech end 34 of the barrel 26. Cam follower 32 engages the cam 20 and contacts the cam surfaces 24. Interaction between the cam follower 32 and the cam 20 rotates the barrel about the longitudinal axis and limits its linear motion along the line of action 18 as described below.

Figure 4:
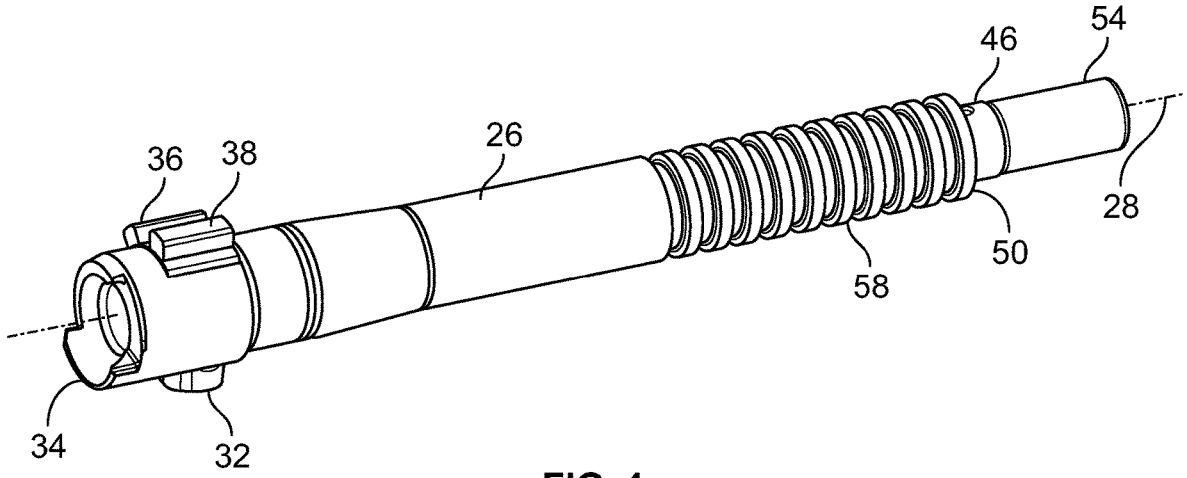
FIG. 4 is an isometric view of a barrel used with the firearm shown in FIG. 1.
Figure 5:
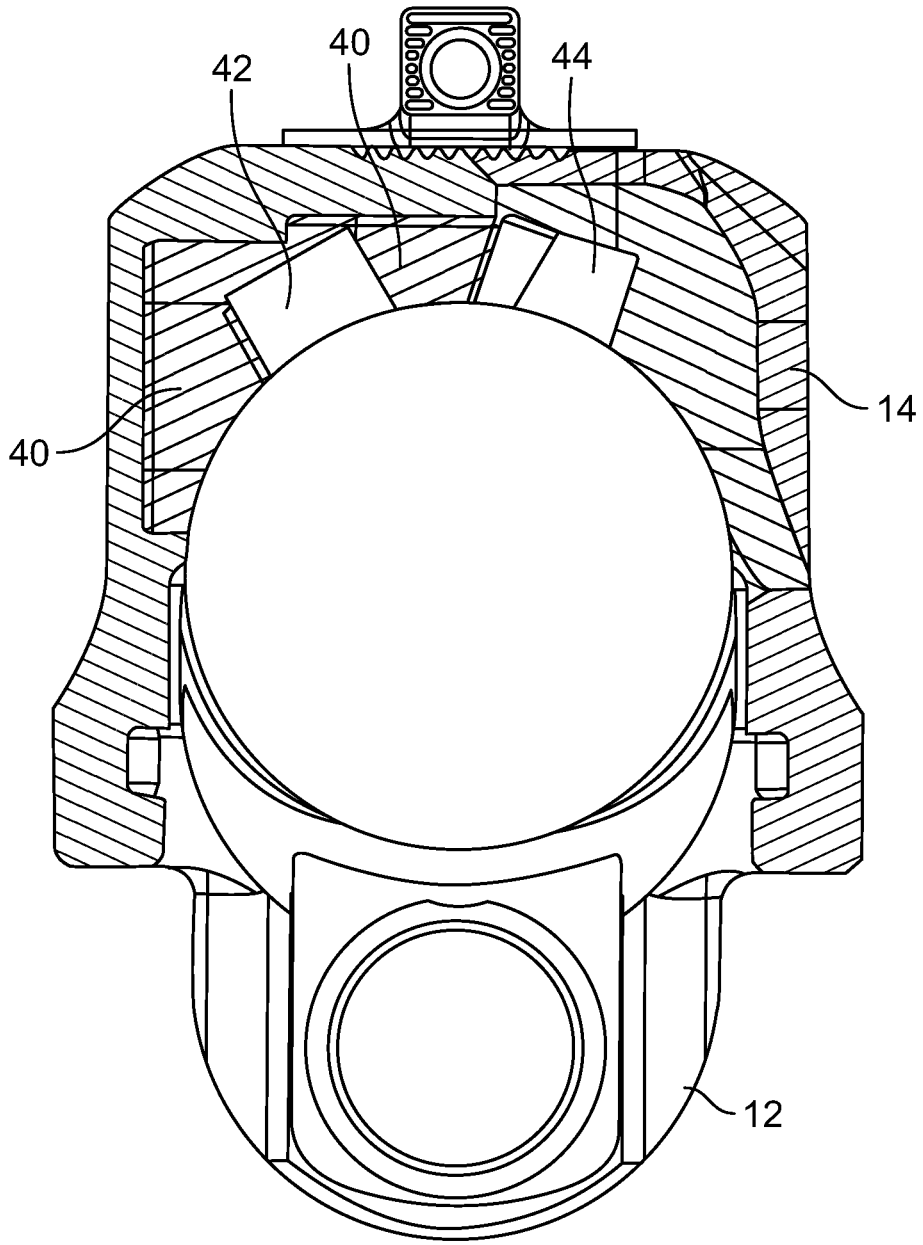
FIG. 5 is a cross sectional view of the firearm shown in FIG. 1.

As shown in FIGS. 2 and 4, one or more lugs, in this example first and second lugs 36 and 38, are mounted on the barrel 26 and project outwardly therefrom. Lugs 36 and 38 are mounted proximate to the breech end 34 of the barrel 26 and serve to prevent relative motion between the barrel 26 and the slide 14 during a portion of the firing cycle when the bolt 16 must remain locked to the breech end 34 of barrel 26. Relative motion between the barrel and slide is prevented when the lugs 36 and 38 engage slide locking surfaces 40 shown in FIGS. 2 and 5. However, slide 14 defines first and second grooves 42 and 44 (see FIG. 5) which extend lengthwise along the slide. Upon rotation of the barrel 26, the first and second lugs 36 and 38 may be brought into alignment with respective grooves 42 and 44. Once the lugs 36, 38 and grooves 42, 44 are aligned, sliding engagement between the lugs and the grooves permits the slide 14 to move independently of the barrel 26 along the line of action 18 as described below.

Figure 6:
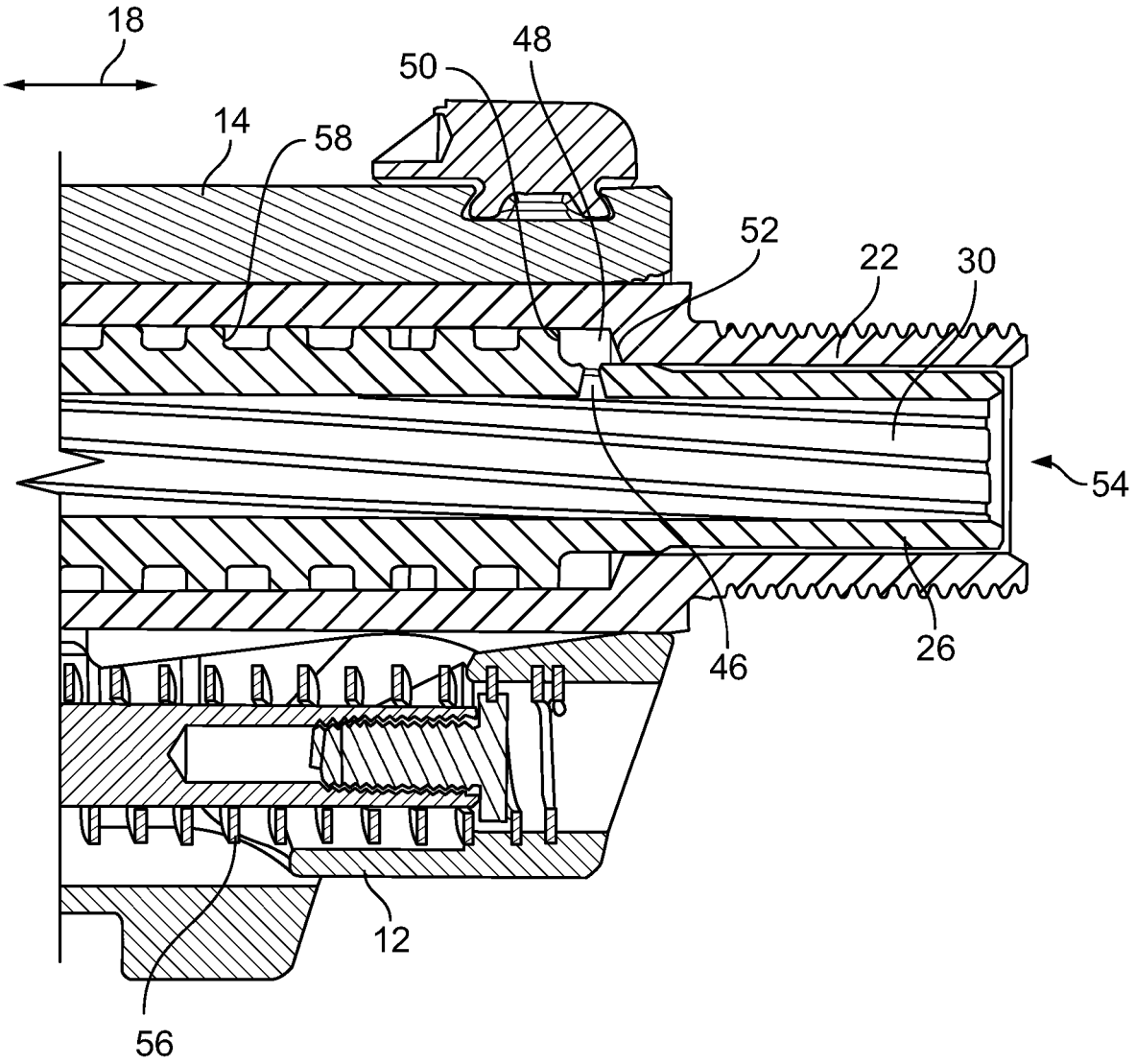
FIG. 6 is a sectional view of a portion of the firearm shown in FIG. 1.

Gas operation of pistol 10 is effected by tapping the expanding propellant gases within the bore 30 defined by the barrel 26. As shown in FIGS. 2 and 6, this is accomplished using a port 46 which extends between the bore 30 and a gas space 48 defined in the space between the barrel 26 and the tube 22. As shown in detail in FIG. 6, a thrust surface 50 projects outwardly from the barrel 26 toward the tube 22. The thrust surface 50 faces a reaction surface 52 projecting from the tube 22 toward the barrel 26, the gas space 48 being defined between the thrust and reaction surfaces, the tube and the barrel. Pressurized gas in the gas space 48 acting on the thrust surface 50 of barrel 26 and the reaction surface 52 of tube 22 will tend to move the barrel 26 and slide 14 along the line of action 18 relative to the tube 22 and frame 12. Note that when the bolt 16 and breech end 34 of barrel 26 are in battery (locked, see FIG. 2), motion of the barrel will also move the slide 14. Initially, there is nothing preventing motion of the barrel 26 or the slide 14 other than the return spring 56 (see FIG. 2) which acts between the slide 14 and the frame 12 to maintain the action in battery (breech and bolt locked). In this example embodiment the port 46 is positioned proximate to the muzzle end 54 of the barrel 26, the position being selected to provide a desired gas pressure within the gas space 48 which will reliably cycle the pistol without excess pressure. In certain circumstances it is advantageous to use a plurality of supplemental thrust surfaces 58 projecting from the barrel 26 toward the tube 22. As shown in FIGS. 2 and 6, the supplementary thrust surfaces 58 are in spaced relation to one another lengthwise along the barrel 26 and provide additional area which increases the gas force on the barrel during cycling of the action.

Operation of the action according to the invention begins with the pistol 10 in battery with a live round 60 chambered in barrel 26 as shown in FIG. 2. A pull of the trigger discharges the round 60, and its projectile 62 travels down the bore 30 of barrel 26 propelled by high pressure gas generated by the burning propellant in the casing 64. Once projectile 62 passes port 46 a portion of the high pressure gas vents into the gas space 48 and acts on the thrust and reaction surfaces 50 and 52 and the supplemental thrust surfaces 58 when present (see also FIG. 6). The barrel 26, subjected to the pressure forces within the gas space 48, begins to move along line of action 18 toward the bolt 16. The bolt 16, itself subject to blow back force from the casing 64, also begins to move away from the muzzle end 54 of pistol 10, driven in significant part by contact with the barrel 26, either direct contact or through the rim of the casing 64. Bolt 16 and slide 14, being one piece, move together along line of action 18 relative to the frame 12, tube 22 and cam 20 which are both fixed to the frame.

As the barrel 26 moves relatively to the cam 20, the cam follower 32 on the barrel 26 (see FIG. 4) engages the cam 20 (see FIG. 3). The cam surfaces 24 are arranged to permit limited linear movement of the barrel along the line of action 18 while also applying a torque to the barrel about the longitudinal axis 28. This torque, generated by contact between the cam follower 20 and the cam surfaces 24 causes the barrel 26 to rotate clockwise about the longitudinal axis 28 as viewed from the breech end 34. This rotation of the barrel 26 aligns the lugs 36 and 38 with the grooves 42 and 44 defined in the slide (see FIG. 5). The cam follower 24 eventually reaches the end of its travel and is stopped by the cam surfaces 24, but the slide 14 has considerable inertia from the impulse provided by the barrel 26 and the casing 64 and continues to travel along the line of action 18 away from the muzzle end 54 of the pistol 10. Because the lugs 36 and 38 are now aligned with the grooves 42 and 44 in the slide 14 and not with the slide locking surfaces 40, the lugs are received within the grooves allowing the slide to continue moving along line of action 18 and out of battery. Bolt 16 thus unlocks from the breech end 34 of barrel 26 and the spent casing 64 is extracted and ejected. The slide 14 is limited in its motion by the return spring 56, which compresses as the slide 14 moves out of battery. Once the slide 14 reaches the end of its travel, the spring 56 then returns energy to the slide, driving it back into battery, but not before the slide strips and chambers the next live round, completing the action's cycle. As the slide 14 engages and moves the barrel 26 toward the muzzle end 54 the cam 20 engages the cam follower 32 and, once the lugs 36 and 38 have disengaged from the grooves 42 and 44, rotates the barrel 26 counterclockwise so that the lugs no longer align with the grooves, but align with the slide locking surfaces 40, thereby preventing relative motion between the barrel and slide by potential contact between the lugs and the slide locking surfaces. When in battery it is expected that a nominal separation of about 0.005 inches between the lugs and the slide locking surfaces will provide a practical design for reliable operation in view of dimensional tolerances.

It is believed that the action according to the invention will allow low recoil impulse rounds to be fired more reliably from semiautomatic firearms.

What is claimed is:

1. A pistol, said pistol comprising:

a frame;

a cam fixedly mounted on said frame;

a slide movably mounted on said frame, said slide defining a first groove extending lengthwise therealong;

a tube fixedly mounted on said frame between said slide and said frame;

a barrel positioned within said tube, said barrel having a longitudinal axis and defining a bore coaxial therewith;

a cam follower mounted on said barrel, said cam follower being engageable with said cam for rotating said barrel about said longitudinal axis;

a first lug mounted on said barrel and projecting outwardly therefrom, said first lug being engageable with said first groove upon rotation of said barrel about said longitudinal axis;

a thrust surface projecting outwardly from said barrel toward said tube, said thrust surface facing a reaction surface projecting from said tube toward said barrel, a gas space being defined between said thrust surface and said reaction surface;

a port in said barrel extending between said bore and said gas space.

2. The pistol according to claim 1, wherein said cam follower is mounted on said barrel proximate to a breech end thereof.

3. The pistol according to claim 1, wherein said first lug is mounted on said barrel proximate to a breech end thereof.

4. The pistol according to claim 1, further comprising a second lug mounted on said barrel and projecting outwardly therefrom, said slide defining a second groove extending lengthwise therealong, said second lug being engageable with said second groove upon rotation of said barrel about said longitudinal axis.

5. The pistol according to claim 4, wherein said first and second lugs are mounted proximate to a breech end of said barrel.

6. The pistol according to claim 1, wherein said port is positioned proximate to a muzzle end of said barrel.

7. The pistol according to claim 1, further comprising a plurality of supplemental thrust surfaces projecting from said barrel toward said tube, said supplementary thrust surfaces being in spaced relation to one another lengthwise along said barrel.

8. The pistol according to claim 1, wherein said cam is integrally formed with said tube.

9. A gas operated action for a firearm, said action comprising:

a tube;

a cam fixedly mounted relatively to said tube;

a barrel positioned within said tube, said tube surrounding said barrel, said tube located between said barrel and a slide, said barrel having a longitudinal axis and defining a bore coaxial therewith, said barrel being movable relatively to said tube;

a cam follower mounted on said barrel, said cam follower being engageable with said cam for rotating said barrel about said longitudinal axis relatively to said tube;

a thrust surface projecting outwardly from said barrel toward said tube, said thrust surface facing a reaction surface projecting from said tube toward said barrel, a gas space being defined between said thrust surface and said reaction surface;

a port in said barrel extending between said bore and said gas space.

10. The action according to claim 9, wherein said cam follower is mounted on said barrel proximate to a breech end thereof.

11. The action according to claim 9, wherein said port is positioned proximate to a muzzle end of said barrel.

12. The action according to claim 9, further comprising a plurality of supplemental thrust surfaces projecting from said barrel toward said tube, said supplementary thrust surfaces being in spaced relation to one another lengthwise along said barrel.

13. The action according to claim 9, wherein said cam is integrally formed with said tube.

14. The action according to claim 9, further comprising:

a bolt movable relatively to said barrel and said tube, said bolt defining a first groove extending lengthwise therealong;

a first lug mounted on said barrel, said first lug being engageable with said first groove upon rotation of said barrel about said longitudinal axis.

15. The action according to claim 14, wherein said first lug is mounted on said barrel proximate to a breech end thereof.

16. The action according to claim 14, further comprising a second lug mounted on said barrel, said bolt defining a second groove extending lengthwise therealong, said second lug being engageable with said second groove upon rotation of said barrel about said longitudinal axis.

17. The action according to claim 16, wherein said first and second lugs are mounted proximate to a breech end of said barrel.

* * * * *